United States Patent [19]

Hawkes

[11] 3,981,540

[45] Sept. 21, 1976

[54] ROCK BREAKING APPARATUS

[75] Inventor: Ivor Hawkes, Lyme, N.H.

[73] Assignee: Creare, Incorporated, Hanover, N.H.

[22] Filed: July 18, 1975

[21] Appl. No.: 597,250

Related U.S. Application Data

[63] Continuation of Ser. No. 408,724, Oct. 23, 1973, which is a continuation-in-part of Ser. No. 372,982, June 25, 1973, abandoned.

[52] U.S. Cl. ..... 299/62; 299/69

[51] Int. Cl.[2] ..... E21C 1/00

[58] Field of Search ..... 299/14, 62, 69, 70, 299/86, 92; 175/360–364, 371–373, 56, 293–299, 135; 152/42, 43, 47–52; 172/519; 404/121; 83/665, 626

[56] References Cited

UNITED STATES PATENTS

| | | | |
|---|---|---|---|
| 698,110 | 4/1902 | Foy | 152/47 X |
| 2,763,469 | 9/1956 | Burls | 175/299 X |
| 3,151,513 | 10/1964 | Rowlands | 83/665 X |
| 3,306,149 | 2/1967 | John | 83/676 |
| 3,718,170 | 2/1973 | Caron et al. | 404/121 X |
| 3,860,292 | 1/1975 | Bechem | 299/14 X |

*Primary Examiner*—Ernest R. Purser
*Assistant Examiner*—Richard E. Favreau

[57] ABSTRACT

An apparatus for breaking and cutting rock and similar materials is provided with one or more roller cutter constructions, each comprising an annular cutter rotatably mounted in a housing. Impact forces are applied directly to the cutter intermittently with a reciprocable hammer. The cutter mountings are constructed to permit the impact force to drive the cutting edge of the cutter into rock while substantially isolating the cutter mountings from the hammer impact and rock reaction forces.

16 Claims, 6 Drawing Figures

ROCK BREAKING APPARATUS

This application is a continuation of application Ser. No. 408,724 filed Oct. 23, 1973, which is a continuation-in-part of application Ser. No. 372,982 filed June 25, 1973, now abandoned.

BACKGROUND TO THE INVENTION

This invention relates to rock breaking apparatus of the type that break out rock fragments by the penetration of metal tools and more particularly to an apparatus capable of imparting high forces to rock cutters in order to drive them into rock and break out rock fragments while transmitting only a small portion of the impact force and rock reaction force to the bearings and shaft or other means which support the cutters. While the apparatus is primarily intended for breaking up rock, it can equally as well be used to break up similar brittle materials such as concrete or ice.

Mechanical equipment currently available for continuously or selectively breaking out rock fragments from massive rock bodies all work by driving a metal tool into the rock surface under the action of high thrust forces. The necessary thrust forces are generated at the tool and rock interface either by the application of high static loads or by impact stresses passing through the tool.

One commonly available type of rock cutting tool is a roller rock cutter used almost exclusively on hard rock tunneling machines and large hole borers, and rolled over the rock surface under essentially steady thrust loads to force the cutting edges into rock as the cutter turns. The cutting edges on the cutters are formed as a tapered disc, studs or gear-shaped teeth and, without exception, require high thrust forces to the order of 40,000 lbs per cutter to penetrate rock and spall out chips. The required thrust is generated by clamping the machine that holds the cutter against the side walls of the tunnel and then jacking between the cutters and clamping points. The cutter thrust load must be applied to the cutting elements through a massive framework and high-load-capacity bearings. Furthermore, up to 30% of the power generated by the apparatus must be expended to rotate the cutters under the high loads merely to overcome the friction between the rock and cutters and the friction in the bearings.

Because of the massive nature of conventional hard rock tunneling machines, several disadvantages exist. For example, because they are so large and heavy, there are major installation and removal problems that can seriously influence their effectiveness. This is particularly the case when access to the forward face of the tunnel is required for drilling and blasting rock that is beyond the rock cutting capabilities of the cutters or where the rock above the tunnel face requires support to prevent rock falls over the machine. Another disadvantage is that the thrust load that can be applied to the cutters on conventional hard rock tunneling machines is limited by the load bearing capacity of the cutter bearings. This limits the hardness of the rock that can be cut by such machines. Further, because the cutter bearings are generally loaded close to their capacity, a high rate of bearing failure is experienced.

Roller-type rock cutters are also widely used on shaft and raise boring machines. In this type of machine, the rotation and thrust on the boring head, onto which the cutters are mounted, is applied through rods connecting the boring head to a drive unit situated at the entrance to the raise or the shaft. The thrust force that can be applied to the cutters is limited by the strength of the drill rods. Because the rods must apply torque in addition to the thrust force, rod failure is a common occurance.

In rock machining and texturing operations that follow quarrying, it is often necessary to machine the rock to specified surface flatness or texture. Currently, this is done by sawing the rock using diamond-tipped circular saws or by abrading the rock using hard metallic powders held in contact with the rock by saws or twisted wire. Another technique that can be used with certain "spallable" rocks is to rapidly heat up the surface of the rock, causing flakes to spall off under the high thermal gradients created. Rock sawing is slow, while diamond sawing is expensive. On the other hand, thermal spalling is suitable for only a few types of rock. Roller-type rock cutters are not suitable for dressing quarried rock, mainly because of the high thrust forces required to drive the cutting edges into the rock and the resulting massive machine framework that would be required to provide and contain these thrusts.

An object of the invention is to provide a roller cutter rock cutting apparatus that can be rolled over the surface of a rock face to break out rock fragments in continuous cuts and in which only a small fraction of the thrusts needed to drive the cutting edges into the rock are applied through the roller cutter support bearings. A further object of the invention is to provide a rock cutting apparatus that does not require a massive support structure and that can be used to selectively break out rock or mineral at the working face in a mine or quarry.

SUMMARY OF THE INVENTION

The present invention is based upon the discovery that the thrust forces necessary to drive a roller cutter into rock to break out rock fragments can be generated by impacting the cutter directly and without damaging or causing high rates of wear to the bearings on which the roller cutter turns, provided that the bearings are substantially isolated from the forces exerted on the cutter such as by employing an elastic means, e.g. an elastic bushing, between the cutter and the bearings.

The cutter is mounted on a shaft set in bearings so that the exposed cutting edge is free to roll over the surface of the rock being cut. A deformable elastic bushing may be interposed between the cutter and the shaft and, in this configuration, the bearings are rigidly clamped to a cutter support housing. Alternatively, the deformable elastic bushing may be interposed directly between the bearings and cutter in which configuration the bearings are positioned within the cutter annulus. Yet another alternative is to mount the deformable elastic bushing between the bearings and the cutter shaft in which configuration the bearings are clamped rigidly to the cutter support housing and two deformable elastic bushings are used, one at each bearing. The definitive term for the deformability of the bushing is its stiffness which is a measure of the force required to produce unit deformation.

The stiffness and elastic properties of the bushing are such that the cutter can move into the rock surface underlying the cutter cutting edge, a distance relative to the bearings and housing sufficient to break out rock chips under the action of an intermittent impact force applied to the rolling cutter, but without significantly loading the cutter bearings or producing significant permanent deformation of the bushing. Typically, the relative motion that can be allowed between cutter and bearings without exceeding the elastic limit of the bushing will be from about one-fourth inch up to 1 inch.

The bushing is preferably a solid elastomeric bushing, but other forms of deformable elastic bushings are not excluded. While the requirements of the invention are readily achieved by the use of a deformable elastic bushing, use of alternative means for isolating the housing from the effects of impacts applied to the cutter are not excluded. In particular, the shaft ends where they protrude from the cutter, can be located in slots in the housing to permit free axial motion in the direction that the impacts are applied while still providing the necessary alignment for the cutter within the housing. In this example, separate elastic means would be provided to ensure that the cutter was located in an optimum position in the slot prior to each impact. Such means could include the use of elastomeric pads mounted at ends of the slot or alternatively coil springs, leaf springs, pneumatic shock absorbers or hydraulic shock absorbers mounted between the shaft and housing or between the shaft and the bearings.

Furthermore, the objects of this invention can be achieved by mounting the shaft ends on bearings within the slots in the housing and positioning the shaft in the slot so that it does not strike the ends of the slots during the use of impact forces in the cutter.

The assembly of roller cutter, deformable elastic means, shaft and bearings will be referred to herein as an impact roller cutter.

The impact roller cutter is in operative engagement with a hammer adapted to apply intermittent impacts to the cutter either directly, but preferably through an anvil placed between the cutter and hammer. The assembly of impact roller cutter, hammer impactor mechanism and housing will be called an impact roller cutter apparatus.

In one use of the invention, a plurality of impact roller cutter constructions are mounted on a rotatable or oscillatable head that positions the cutters on the forward face of a tunnel or borehole and holds them against the rock face with a steady force sufficient to maintain the cutting edges in contact with the rock surface, but with a force much less than would be required to drive the cutters into the face to break out chips without impacting the cutter.

DETAILED DESCRIPTION OF THE DRAWINGS

Figure 1:
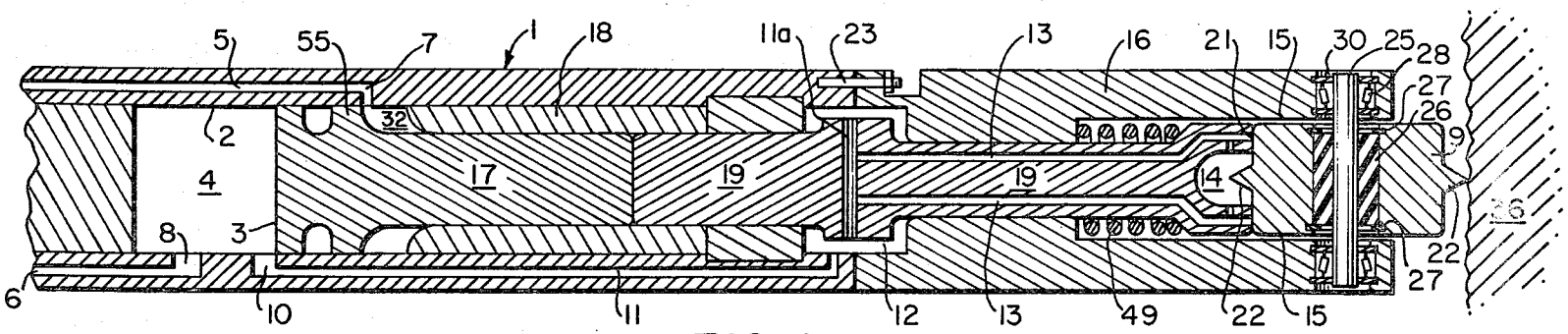
FIG. 1 is a cross-sectional view of an impact roller cutter construction according to the invention, and which incorporates a pneumatically driven hammer.

Referring to FIG. 1, the pneumatic motor portion comprises a generally cylindrical casing 1 having a bore 2 in which is placed a reciprocable hammer 3. The hammer 3 is adapted to reciprocate within chamber 4 under fluid pressure supplied through fluid inlet passages 5 and 6 and fluid inlet ports 7 and 8. The hammer 3 is guided within chamber 4 by means of bore 2.

The embodiment shown in FIG. 1 is provided with means for supplying exhaust gas to the cutter 9 in order to remove spalled rock from contact with the cutter 9. A fluid exhaust port 10 communicates with chamber 4 and with fluid exhaust passage 11 which supplies exhaust gas to passage 11a, chamber 12, passage 13 and chamber 14. Exhaust fluid is supplied to the exterior of the cutter 9 from chamber 14 through spaces 15 between the cutter 9 and the cutter housing 16, and around the periphery of the cutters.

The forward portion of hammer 3 is provided with a striking portion 17 which is guided by the bore of bushing 18 and is positioned to strike the anvil 19 following reciprocation. The forward end of the anvil 19 is shaped to conform to the outer peripheral surface 21 of the cutter and to prevent contact of the anvil 19 with the cutter edge 22. It is advantageous but not essential to hold the forward end of the anvil 19 in contact with said peripheral surface by a compression spring 49. The housing 16 and casing 1 can be attached in any convenient manner as for example by the use of plurality of bolts 23.

The cutter 9 is positioned on a shaft 25 which in turn is surrounded by an elastomeric bushing 26 which bushing 26 is retained at the central portion of the shaft 25 by means of rings 27. The outer ends of the shaft 25 are rotatably mounted with roller bearings 28 so that the bit 9 is free to rotate. A plate 30 is provided at each side of the roller bearings 28 to seal the roller bearings 28 from dust and moisture.

In operation, the hammer 3 is driven toward the cutter 9 by pneumatic pressure entering chamber 4 through inlet port 8 until hammer 3 has passed exhaust port 10 which causes the pneumatic pressure in chamber 4 to be substantially reduced. The hammer striking portion 17 strikes anvil 19 which in turn transmits the impact force to the outer surface 21 of cutter 9 and thus drives the cutter edge 22 into rock 36. When hammer 3 has by-passed exhaust port 10, the pressure in chamber 4 is reduced and, concomitantly, the pneumatic pressure in chamber 32 is increased by virtue of gas being introduced thereto through inlet port 7. Hammer 3 is then caused to move in a rearward direction until it has by-passed exhaust port 10 and the gas in chamber 32 is exhausted therefrom through exhaust port 10 and concomitantly pneumatic pressure in chamber 4 is increased in the manner described above.

When the cutter edge 22 is forced against the rock by a static force, not shown, applied axially along the cylindrical housing 1, the bushing 26 deforms to balance the load and the anvil 19 is pushed into sleeve 18. With the anvil 19 positioned in this manner in sleeve 18, the hammer strikes its greatest impact against the anvil 19. If the cutter edge 22 moves out of contact with rock the anvil 19 moves out of the sleeve 18 as the static rock load on the cutter 22 is relieved. As the anvil 19 moves out of sleeve 18, hammer 3 has to travel further during its impact stroke and the air trapped in chamber 32 becomes highly compressed, cushioning the impact of the hammer onto anvil 19, and reducing the intensity of the blow. By this means the intensity of the impact on the cutter is reduced when the cutter edge is not in contact with the rock, and the bushing does not have to absorb the full impact energy of the hammer blow. This technique is well known in the design of percussive pneumatic rock drills, where it is used to prevent damage to the drill and drill rods.

Figure 2:
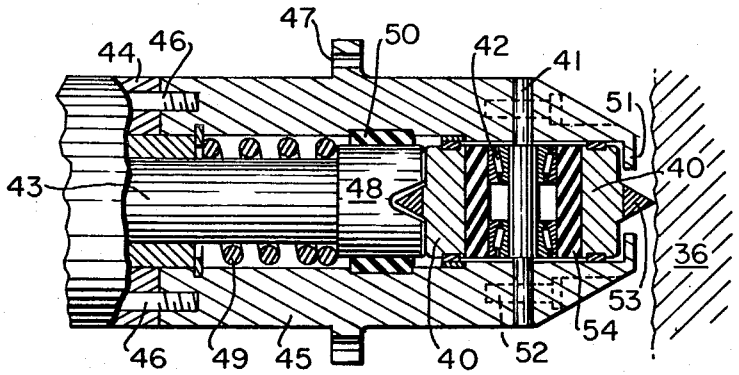
FIG. 2 is a partial cross-sectional view of an alternative impact roller cutter construction of this invention.
Figure 3:
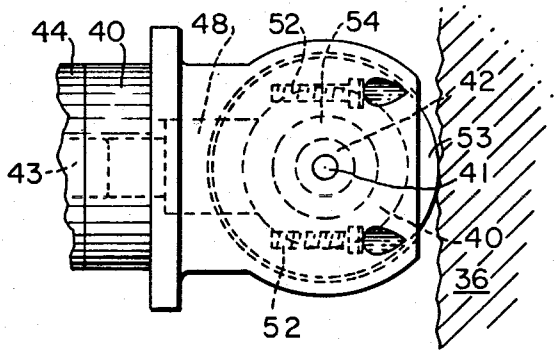
FIG. 3 is a side view of the cutter shown in FIG. 2.

Referring to FIGS. 2 and 3, an alternate method of mounting the shaft 41 and bearings 42 and bushing 54 in cutter 40 is shown. The housing 44 for the hammer is shown connected to the anvil housing 45 by means of bolts 46. The anvil housing 45 is provided with a mounting flange 47 to permit attachment to a tunneling tool head or other structure (not shown). The anvil 48 is biased in contact with the bit 40 by means of spring 49. The anvil 48 is maintained in position by means of a sleeve 50. The erosion shield 51 is mounted on the anvil housing 45 by means of bolts 52. An elastomeric bushing 54 is interposed between the cutter 40 and the bearings 42.

Figure 4:
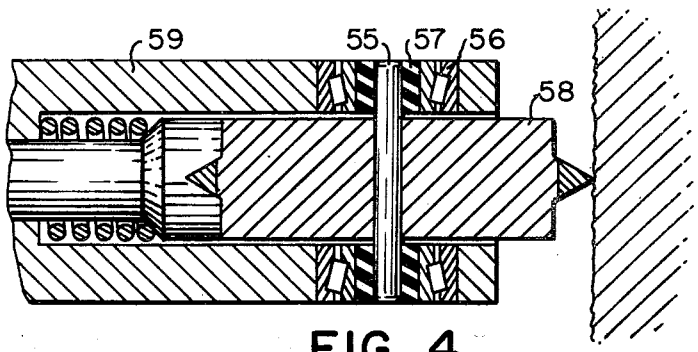
FIG. 4 is a partial cross-sectional view of a third alternative impact roller cutter construction of this invention.

FIG. 4 shows a third method of mounting the shaft 55 and bearings 56 and bushing 57 and cutter 58 in the housing 59.

Because of the oscillating nature of the hammer motion and the intermittent penetration of the cutter into the rock as it is traversed over the rock surface, the impact roller cutter apparatus has a tendency to bounce away from the rock surface and this must be countered by a static thrust force on the apparatus. Referring again to FIG. 1, during operation the exposed cutter edge 22 must be held against the rock face with a force sufficient to ensure that the cutter is in contact with the rock when the hammer 17 strikes the anvil 19. Experimentally, it has been found that the required static thrust force necessary to prevent bouncing and maintain the cutting edge in contact with the rock surface when using the impact roller cutter apparatus is of the order of 10% of the static thrust force required on a conventional roller rock cutter breaking out rock at an equivalent rate.

The elastomeric bushing 26 substantially isolates the shaft 25 and bearings 30 from the impact forces generated by hammer 17 and ensures that the bulk of the impact energy of the hammer 17 is delivered to the cutting edge for rock breaking. The stiffness of the elastomeric bushing 26 is controlled by its dimensions, its containment and the modulus of elasticity of the bushing material. The upper limits of its stiffness are fixed to large extent by the need to limit the energy absorbed by the bushing during its deformation as the cutter edge 22 penetrates the rock. When the impact energy is low, (e.g. up to 100 ft-lbs) and/or the rock being cut is hard (e.g. compressive strengths above 25,000 psi) the cutter will only move into the rock a very small distance relative to cutter mountings before the rock starts to chip and fragment, (e.g. less than ⅛ inch.) In contrast, when the impact energies are relatively high (e.g. over 100 ft-lbs) and the rock being cut is soft, (e.g. less than 15,000 psi compressive strength) then the cutter may penetrate with multiple rock chipping and fragmentation to depths of more than 1/2 inch. The invention does not require precise specification of the elastomeric bushing stiffness. Bushing stiffnesses ranging from 5,000 to 50,000 lbs/in. could be used with impact roller cutters impacted with blow energies ranging from 10 to over 1,000 ft-lbs. A bushing would be too stiff if a significant amount of the energy was absorbed in deforming the bushing (e.g. over 25% of impact energy), and a bushing would be too soft if the low frequency, high amplitude, vibrations of the cutter on the bushing between impacts caused high wear on the moving parts or difficulties in controllably traversing the cutter over the rock surface.

Figure 6:
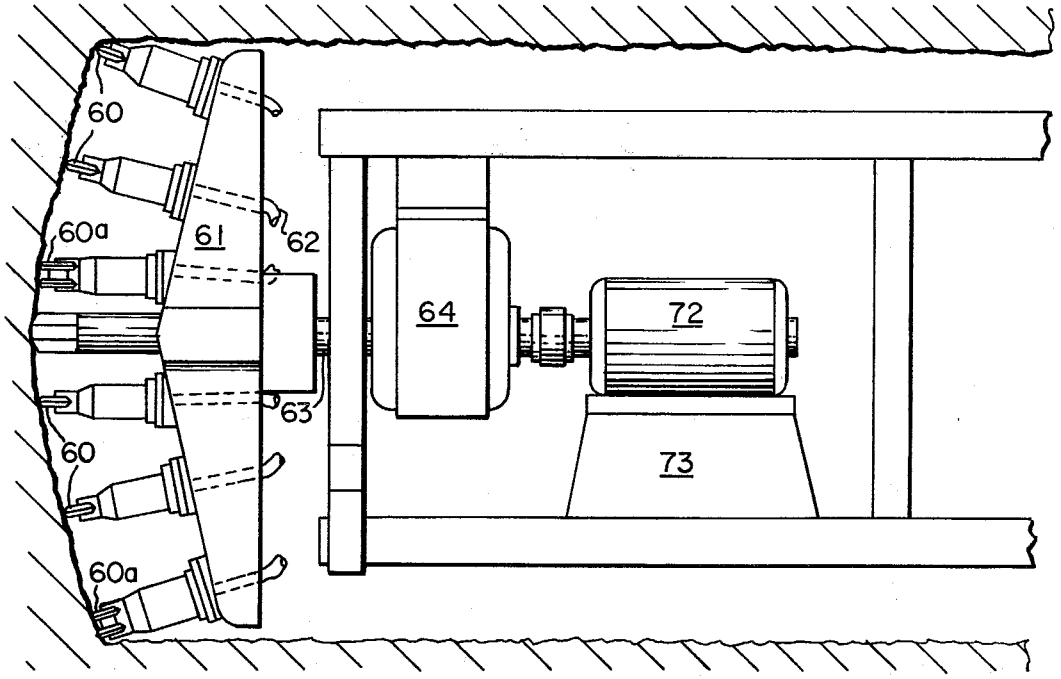
FIG. 6 is a partial top view of the apparatus of FIG. 5.
Figure 5:
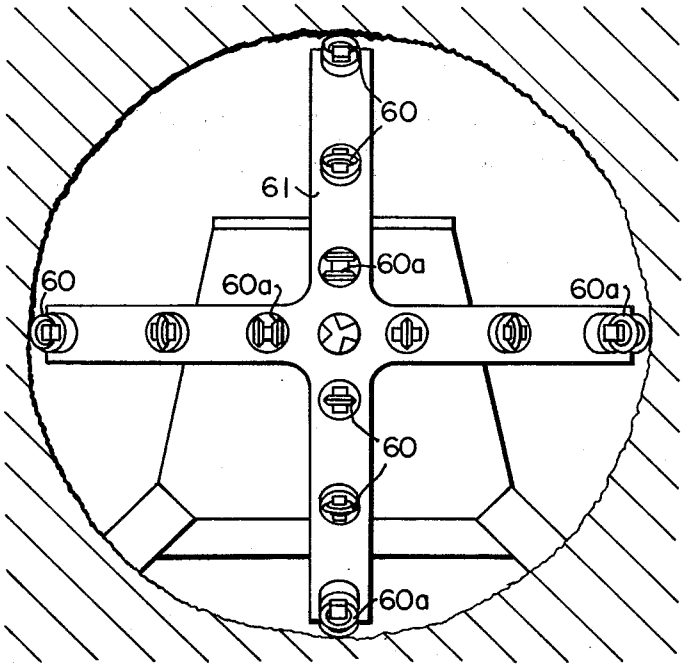
FIG. 5 is a front view of a tunneling apparatus having an oscillating head with the cutter construction mounted thereon.

Referring to FIGS. 5 and 6, representing one possible arrangement incorporating the invention into a tunneling machine, a plurality of the impact roller cutter constructions 60 are mounted on a rotatable or oscillatable head 61. If desired, some of the cutter bit constructions **60*a* can be provided with a plurality of cutters. Each cutter bit construction 60 and 60*a* is connected to a source of fluid pressure (not shown) by means of hoses 62. The head 61 is mounted on a shaft 63 which is driven by a motor 72 through a gear box 64. Motor 72 is attached to mounting 73 and can be adapted to oscillate or rotate as desired to oscillate or rotate the head 61.**

The cutters employed in this invention can have any useful shape. Thus, they can be configured as a tapered disc, or with gear-shaped teeth or with protruding studs. Also, one or more cutter edges can be located on a single cutter body. While this invention has been described particularly with reference to the apparatus shown in the drawings, it is to be understood that any conventional cyclical impactor can be employed with the cutter bit construction of this invention.

I claim:

1. An impact roller cutter assembly comprising: a unitary, rigid annular metal cutter having an axis of rotation and including a radially outwardly extending peripheral cutting portion, said cutter having a separate outer peripheral impact receiving portion spaced radially inwardly of said cutting portion and being the only portion of said cutter adapted to have controlled actuating impact blows delivered thereto; an elongated shaft extending substantially coaxially with said axis and supporting said cutter and adapted to be supported by a housing; elastomeric bushing means having the outer periphery thereof in engagement with at least an inner peripheral portion of said cutter and extending radially inwardly therefrom; and said bushing means being of a stiffness to deform in response to individual impact blows of such impact blows providing limited transverse movement of said cutter with respect to the longitudinal axis of said shaft.

2. A roller cutter assembly as specified in claim 1 additionally including bearing means disposed intermediate said bushing means and said shaft to rotatably support said bushing means with respect to said shaft.

3. A roller cutter assembly as specified in claim 1 additionally including bearing means disposed intermediate said shaft and such a housing and which are adapted to rotatably support said shaft with respect to such a housing.

4. An impact roller cutter assembly comprising: a unitary, rigid annular metal cutter having an outer peripheral cutting portion and a separate outer peripheral impact receiving portion spaced radially inwardly of said cutting portion; said cutter being adapted to be operationally supported to have impact blows delivered to said impact receiving portion only to cause actuation of said cutter; an annular elastomeric bushing means having the outer periphery thereof in engagement with at least an inner peripheral portion of said cutter and extending radially inwardly therefrom; and said bushing means being of a stiffness that the maximum energy which can be absorbed by said bushing does not exceed twenty-five percent (25%) of the energy delivered to said cutter by the individual blows of such impact blows.

5. A roller cutter assembly as specified in claim 4 additionally including an elongated shaft adapted to be supported by such a housing and supporting said cutter and extending substantially coaxially through said bushing means to permit a limited transverse movement of said cutter with respect to the longitudinal axis of said shaft in response to the energy delivered by such impact blows to said cutter.

6. A roller cutter assembly as specified in claim 5 additionally including bearing means disposed intermediate said bushing means and said shaft for rotatably supporting said bushing means with respect to said shaft.

7. A roller cutter assembly as specified in claim 5 additionally including bearing means disposed intermediate said shaft and such a housing and which are adapted to rotatably support said shaft with respect to such a housing.

8. An impact roller cutter apparatus comprising: a housing member; an elongated cutter shaft supported by said housing member; an annular metal cutter member supported by said shaft and rotatably supported with respect to said housing member; an impacting means supported with respect to said cutter member and operable to periodically apply impact forces to an outer portion of said cutter member; and elastomeric means between said shaft and one of said members deformable in response to individual impact forces for permitting limited transverse movement of said cutter member with respect to the longitudinal axis of said shaft.

9. An impact roller cutter apparatus as specified in claim 8 wherein said impacting means comprises a piston assembly and such impact forces are imparted to said cutter member by the reciprocable piston of said piston assembly striking said outer portion.

10. An impact roller cutter apparatus as specified in claim 8 wherein said elastomeric means comprises a readily deformable annular elastomeric bushing cooperable with and disposed intermediate said cutter member and said shaft.

11. An impact roller cutter apparatus as specified in claim 10 additionally including bearing means disposed intermediate said bushing and said shaft for rotatably supporting said bushing with respect to said shaft.

12. An impact roller cutter apparatus as specified in claim 10 additionally including bearing means disposed intermediate said shaft and said housing member for rotatably supporting said shaft with respect to said housing member.

13. An impact roller cutter apparatus as specified in claim 8 wherein said elastomeric means comprises spaced readily deformable annular elastomeric bushings cooperable with and disposed intermediate said shaft and said housing member.

14. An impact roller cutter apparatus as specified in claim 13 additionally including bearing means disposed intermediate said bushings and said shaft member for rotatably supporting said shaft member with respect to said housing member.

15. A tunneling apparatus comprising a plurality of impact roller cutter apparatus as specified in claim 8 mounted on a boring head assembly and means to move said head in a manner that said cutter members are adapted to roll over the forward face of a tunnel.

16. A tunneling apparatus as specified in claim 15 including additional means to advance said boring head assembly towards said face.

* * * * *